US008939548B2

(12) United States Patent
Newton et al.

(10) Patent No.: US 8,939,548 B2
(45) Date of Patent: Jan. 27, 2015

(54) LAMINATION PROCESSES

(71) Applicant: Xerox Corporation, Norwalk, CT (US)

(72) Inventors: Tygh J Newton, Sherwood, OR (US); Ruander Cardenas, Wilsonville, OR (US); John R Andrews, Wilsonville, OR (US); Tony R Rogers, Milwaukie, OR (US); Mark Maynard, Salem, OR (US); James D Padgett, Lake Oswego, OR (US); Chanthy Luy, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 125 days.

(21) Appl. No.: 13/791,994

(22) Filed: Mar. 9, 2013

(65) Prior Publication Data

US 2014/0253637 A1 Sep. 11, 2014

(51) Int. Cl.
*B41J 2/16* (2006.01)

(52) U.S. Cl.
CPC ..... *B41J 2/1623* (2013.01)
USPC ..... 347/45; 347/71

(58) Field of Classification Search
CPC ..... B41J 2/1623; B41J 2/1631; B41J 2/1642; B41J 2/14; B41J 2/16; B41J 2/17513; H01L 25/0657; H01L 41/053; H01L 21/67173; H01L 27/1425
USPC ..... 347/40, 42, 45, 47, 49, 65, 71
See application file for complete search history.

(56) References Cited

U.S. PATENT DOCUMENTS

| | | | | |
|---|---|---|---|---|
| 6,135,586 | A | 10/2000 | McClelland et al. | |
| 6,386,434 | B1 | 5/2002 | Wong | |
| 7,600,863 | B2 | 10/2009 | Brick et al. | |
| 8,251,490 | B2 * | 8/2012 | Ciampini et al. | 347/45 |
| 8,500,246 | B2 * | 8/2013 | Park et al. | 347/44 |

* cited by examiner

*Primary Examiner* — Thinh Nguyen
(74) *Attorney, Agent, or Firm* — Eugene O. Palazzo

(57) ABSTRACT

A process where there is deposited on a supporting substrate at least one first polymer layer and optionally at least one second polymer layer followed by treating the resulting formed layers or laminate with a laser.

20 Claims, 3 Drawing Sheets

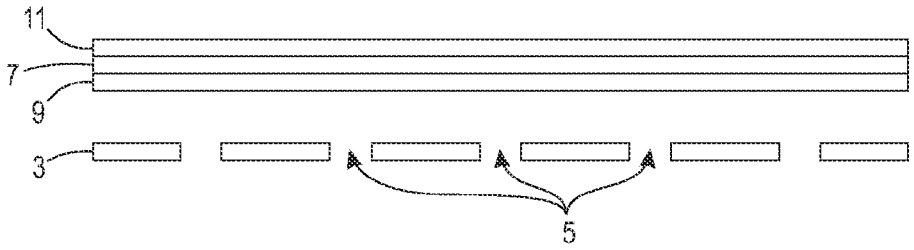
FIG. 1A
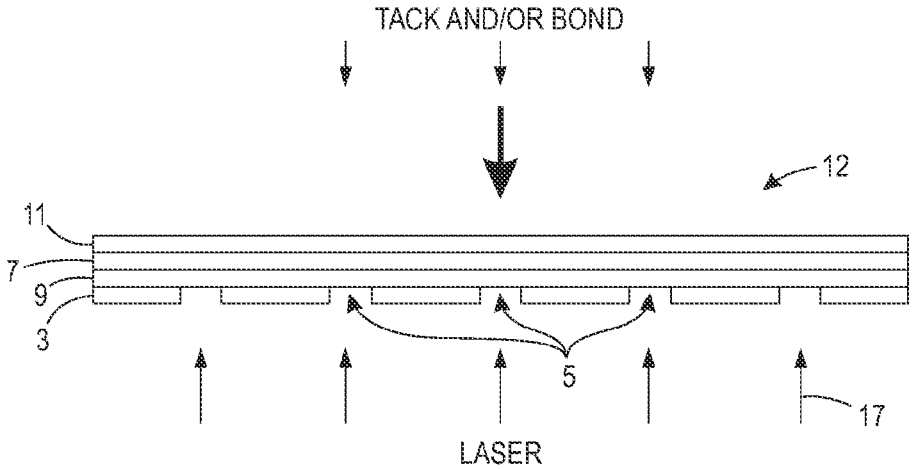
FIG. 1B
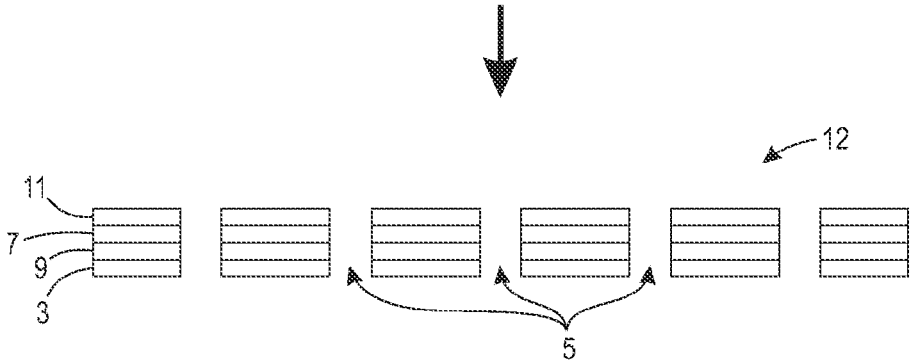
FIG. 1C
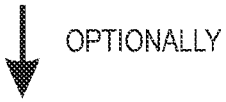

LAMINATION PROCESSES

This disclosure is generally directed to lamination processes, and where there is prepared laminated layers with aligned channels or openings therein and inkjet print heads thereof.

BACKGROUND

There are known a number of processes for aligning and bonding polymers to mating plates where, for example, two cut sheets with specific patterns encompass the mating plate. The cut sheets can then be independently and mechanically aligned within an assembly to perform specific functions. However, disadvantages with these processes are that proper alignments are dependent on factors, such as the materials, like polymers selected, humidity conditions, design features, and rigidity of the parts, which renders part-to-part alignment increasingly difficult and not achievable in some instances. Also, costly automated optical alignment equipment and humidity/temperature control devices are often not sufficient to obtain an acceptable alignment of, for example, substantially all the channels present in ink jet heads. Misaligned areas, such as ink channels, cause ink droplets to eject at different angles resulting in images on a printed surface to be of a poor or unacceptable quality. Additionally, because of the misalignment of the areas and openings between a mating member and the layers coated thereon, there is a decrease in the amount of material being ejected, and eventually the apparatus in which these mating members are utilized can be rendered inoperative, and where the areas, channels, or apertures become plugged. Further, with these processes there can result internal ink leaking and color mixing, and there can be formed obstructed fluidic paths to and from the print head.

In some known thermal and piezo driven inkjet print heads, the aperture layer or layers may be a polymer layer in which apertures are formed using laser ablation. The advantages of using a polymer layer include low cost and the ability to taper or otherwise shape the apertures. Using a polymer layer can present challenges to print head design in that the outlet plate is generally prepared from a metal layer, such as stainless steel, and where the metal layer is etched with openings that fluidly couple the apertures in the polymer aperture plate to a pressure chamber in a body layer once the print head assembly is completed. Since the apertures in the polymer aperture plate are smaller than the openings in the outlet plate, solid portions of the polymer aperture plate extend over the openings in the outlet plate. Thus, the attendant lack of support for these portions as the metallic outlet plate is pressed against the polymer aperture plate produces uneven pressure on the polymer aperture plate and causes the polymer aperture plate to warp and form dimples resulting in the warped apertures ejecting droplets at different angles, and different shapes thereby reducing print quality.

The lack of flatness in the aperture plate or layer arising from the application of uneven pressure to polymer layers is known, and where there is cut extra trenches in a silicon die mounting material to produce unsupported areas of the aperture plate that are symmetrical with regard to the apertures in the polymer aperture layer. These symmetrical unsupported areas help reduce errors in apertures caused by the polymer layer warping. While this method attempts to reduce the negative effects caused by warped channels and nozzles, there is the unresolved problem that the polymer aperture plate is being warped during the print head fabrication process.

Additionally, a problem with print heads is that the channels are of a small size of area and the non-registration or non-alignment of one orifice to another creates objectionable print quality, therefore orifices need to be properly assembled, and where their dimensions thereof are substantially constant over extended time periods with variations in temperature. Further, the use of several different materials in the preparation of an ink jet print head, especially the assembly of page-wide print heads, is that polymers selected have differing coefficient of thermal expansions which leads to unacceptable registration or non-aligning of channels with temperature changes.

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates opposite a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper.

In current inkjet printers of the type disclosed in U.S. Pat. No. 7,600,863, the disclosure of which is totally incorporated herein by reference, and in which the mating plates or laminated layers illustrated herein can be incorporated, an inkjet jet stack can contain from 16 to 20 gold-plated stainless steel plates that are brazed together. Cavities etched into each plate form channels and passageways for containment of ink for each individual jet. Larger cavities align to form larger passageways that run the length of the jet stack. These larger passageways are ink manifolds arranged to supply ink to individual jets for each color of ink. Up to eight of these plates can be used to create the manifolds to ensure a large enough cross-section to avoid ink starvation of the individual jets when writing solid colors while retaining the manifold internal to the jet stack.

To increase printing speed, the number of jets may be increased within a jet stack and firing frequency of the jets may be increased. Increasing the number of jets and firing frequency using the above-described ink manifold design would require increasing the size of the ink manifold which, in turn, means using more plates to achieve a large enough cross-section. Also, individual gold-plated stainless steel plates are expensive, so increasing the number of plates quickly increases the cost of the jet stack.

Typically there are four ink colors used within a jet stack. The ink jets for each color are widely distributed across the face of the jet stack. The passageways from each ink manifold follow paths to the widely distributed individual jets and cross above and below each other, which adds to the height of the jet stack requiring more plates. This geometry necessary within the stack also makes the passageways from the manifolds to the individual jets relatively long and circuitous, which adds drag to the ink flow limiting the mass throughput of ink to the individual jets.

There is a need for lamination processes that substantially avoid or minimize the disadvantages of a number of known processes.

Further, there is a need for ink jet mating laminates that can be prepared by economical processes.

Also, there is a need for processes where there is achieved the alignment of supporting substrate openings and a plurality, such as two polymer layers with openings, and where the polymer layers enclose the supporting substrate situated there between.

Another need resides in the provision of the laser ablation processes that generate openings in a laminate, and where the laminate can be selected for a number of different uses, such as in ink jet print heads, that can be incorporated into ink jet systems.

Yet another need resides in processes that generate consistent and acceptable ink jet laminates where the channels or openings therein are in alignment with the channels present in the polymer layers that encompass the supporting substrate.

Moreover, there is a need for ink jet print heads where the ink channels eject ink in a preselected continuous manner that results in images of acceptable resolution, and where the ink and the image are robust or possess robustness.

There is also a need for mating devices and plates that can be economically prepared with minimal or substantially no contamination in a manner that allows the full alignment of each of the channels present in the plate and in the polymer or polymers present on each side of the plate.

Additionally, there is a need for laminated plates or layers where the polymers on each side of the plates remain attached to the plates for extended periods of time.

These and other needs are achievable in embodiments with the mating plates and components thereof disclosed herein.

SUMMARY

There is disclosed a process comprising applying to a supporting layer, that optionally includes openings therein, at least one first polymer layer, and subjecting the supporting layer and the at least one first polymer layer to a laser source that forms openings in the supporting substrate and the at least one first polymer layer, and where openings in the at least one first polymer layer are aligned with the openings in the supporting substrate; a process comprising providing a supporting layer that includes openings therein, and where the supporting layer is situated between and is in contact with at least one polymer layer optionally containing an adhesive layer on at least one lateral surface thereof; applying the at least one polymer layer on the top surface of the supporting layer and subjecting the supporting layer and the at least one polymer layer to a laser that forms openings in the at least one polymer layer; applying at least one second polymer layer on the bottom surface of the supporting layer and subjecting the at least one second bottom polymer layer to a laser that forms openings in the at least one second polymer layer, and where openings in the at least one first polymer top layer and the openings in the at least one second polymer bottom layer are aligned with the openings in the supporting substrate; and a solid ink jet device that includes an ink jet stack comprised of at least one first polymer layer, at least one second polymer layer, and situated there between at least one supporting substrate layer, and wherein the supporting substrate layer, the at least first polymer layer and the at least second polymer layer are simultaneously exposed to a laser to generate aligned openings in the supporting substrate layer, the at least one first polymer layer and the at least one second polymer layer.

FIGURES

The following Figures are provided to further illustrate the laminates disclosed herein.

FIGS. 1A through 1E illustrate an exemplary embodiment of the present disclosure.

EMBODIMENTS

For a general understanding of the environment for the processes and laminates disclosed herein, a printer encompasses any apparatus that performs a print outputting function for any suitable purpose, such as aqueous ink jet systems, solid ink jet systems that contain known gel inks and known wax-based inks, and where inks can also refer to any fluid that can be driven from ink jets including water-based solutions, solvents and solvent based solutions, and UV curable polymers. The word polymer means, for example, any one of a broad range of carbon-based compounds formed from long-chain molecules including thermoset polyimides, thermoplastics, resins, polycarbonates, and related compounds known to the art. The word metal means, for example, either single metallic elements including, but not limited to, copper, aluminum, or titanium, or metallic alloys including, but not limited to, stainless steel or aluminum-manganese alloys. Plurality and at least one first polymer and at least one second polymer means, for example, from about 1 to about 15, from about 1 to about 10, from about 2 to about 7, from 1 to about 5, from 1 to about 3, from 2 to about 5, or from 1 to 2 layers. Rigid refers, for example, to a plate, supporting substrate, or layer exhibiting sufficient stiffness that bowing or other dimensional displacement that adversely impacts the jetting of ink droplets from the openings in the polymer layers does not occur. Rigid refers, for example, to both rigid and semi-rigid layers.

Generally, with respect to the present disclosure and the FIGS. 1A through 1E and 2, there is tacked or bonded a blank sheet of a polymer film or a plurality of sheets of polymer film, to one side of a mating plate or mating layer having channels etched therein, followed by aligning a laser with the channels of the mating plate, and ablating the features, such as by forming channels in the polymer film. Following the first laser ablation process, a second blank sheet of polymer film or a plurality of sheets of polymer film is tacked or bonded on the side of the mating plate that is opposite the first polymer. The laser is again aligned with the channels of the mating plate and the features on the second polymer layer are then ablated.

In FIGS. 1A to 1E, the disclosed processes and laminated structures thereof are, more specifically, illustrated, and where the same numerals represent the same layers of the laminates shown.

Figure 1D:
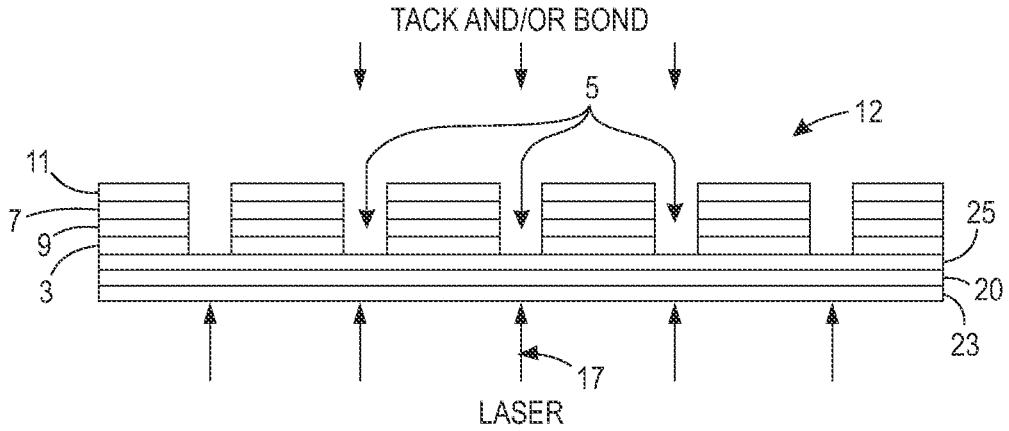
Figure 1E:
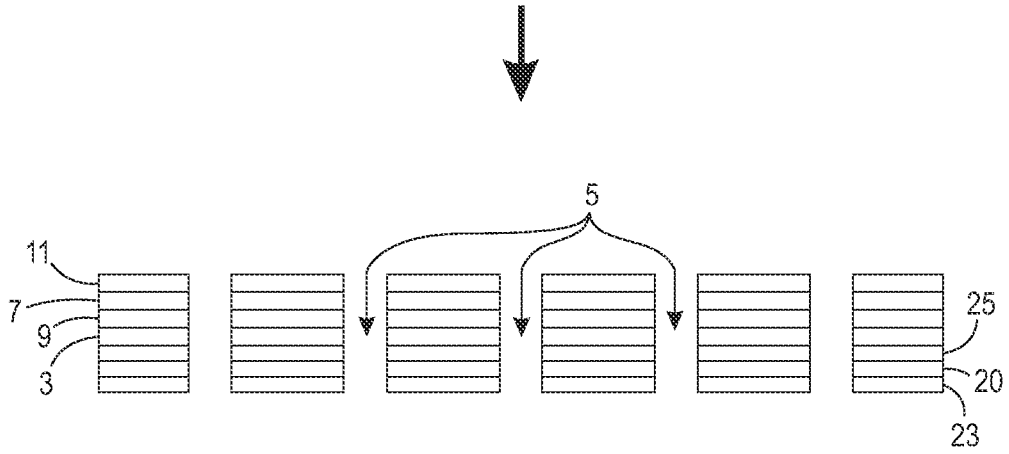

FIG. 1A illustrates a layer 3 serving as a supporting layer or a supporting substrate layer, such as a mating plate or an outlet plate, that can originally include or that can or later include a plurality of channels, openings, or cutouts 5, that function primarily as ink jet delivery sources, formed in-place by a number of methods, such as die cutting, laser cutting, using, for example, a diode pumped solid state laser, an excimer laser or a carbon dioxide laser, or where such a supporting substrate layer can also be purchased with openings or channels preformed therein; a first polymer layer 7 with optional adhesive layers 9 and 11, which subsequent to tacking, bonding, or tacking and bonding the first polymer layer 7 with, for example, heat and pressure, there is formed the laminate 12 (FIG. 1C), with ink channels or openings therein 5. Subjecting the laminate of FIG. 1B to tacking, bonding, or both tacking and bonding with a laser as represented by arrows 17, there results the laminate 12 of FIG. 1C where the designations 3, 5, 7, 9 and 11 are equivalent to the respective designations in FIG. 1B. Thereafter, the laminate of FIG. 1C optionally has attached thereto by, for example, heat and pressure a second polymer layer 20 with optional adhesive layers 23 and 25 as shown in FIG. 1D, where the designations 3, 5, 7, 9 and 11 are equivalent to the respective designations in FIG. 1B. Thereafter, by repeating the process of FIG. 1B, inclusive of subjecting the laminate layers of FIG. 1D to a laser, there is formed the laminate of FIG. 1E, where the designations 20, 23 and 25 are equivalent to the respective designations in FIG. 1D, where the designations 3, 7, 9 and 11 are equivalent to the respective designations in FIG. 1B, and where the openings 5 are fully aligned.

With further respect to FIGS. 1A to 1E, initially a first polymer layer is tacked and then bonded to the supporting substrate or mating plate with, for example heat and pressure or other suitable methods. Subsequently, there is accomplished a first laser cutting or ablation of the first polymer film bonded to the supporting substrate by, for example, placing the resulting semi rigid laminate on a holding substrate that secures it in the image plane of a laser cutting system. Within the laser system, the first polymer layer bonded to the supporting substrate is aligned to the laser cutting system with, for example, mechanical fixturing using alignment pins or other aligning surfaces. For the alignment sequence, there can be used a number of methods, such as a camera, an electron microscope, and the like, to locate the alignment features at least two locations on the supporting substrate and motorized motion systems to align the supporting substrate, and the laser or the laser cutting system to the substrate. The alignment features, patterns, channels, or openings are then cut or etched with the laser system.

Thereafter, the resulting layers with aligned openings are cleaned of any contamination and debris generated as a result of handling and laser ablation by a combination of a wash-line and oxygen plasma cleaning. However, other suitable or known cleaning methods and a combination of cleaning methods can be selected for the removal of contamination and debris.

Optionally, a second polymer layer blank with an adhesive layer or layers attached thereto is tacked, bonded, or tacked and bonded to the supporting substrate in opposite position to the first polymer layer, followed by a second laser cutting. In the second laser cutting or etching, the laminate of the formed first laser cutting is placed in the disclosed laser system with the second polymer layer facing the laser beam output lens. However, in some instances to economically accomplish a more perfect alignment of the second laser cut features with the first laser cut features, the second laser cut process can be accomplished at two different laser focal depths. First, the laser is focused onto the second polymer layer to ablate the features therein. Generated slugs and debris can be extracted therefrom during the ablation process utilizing a vacuum through the openings on the first polymer layer. If the features on both polymer layers are not properly aligned, it is possible to partially damage the first polymer layer while cutting the second polymer layer, which could result in partially cut slivers on the first polymer layer. To substantially eliminate or mitigate this problem, an additional laser cutting can be superimposed on the last or more recent laser cut with the laser focused on the first polymer layer. This additional laser ablation avoids any damage to the first polymer film generated during ablation of the second polymer film and provides a clean cut through both polymer layers. Thus, the second polymer layer with adhesives thereon is then tacked and bonded to the supporting substrate followed by directing laser beams thereon by repeating the above process for the depositing and for laser exposure of the first polymer layer.

The formed laminates can be a complete assembly or the obtained laminates can be included in a larger assembly where parts, such as ink jet print heads, are bonded to outside or top and bottom polymer adhesive layers of the laminate. One design rule for a 2/2-layer processing include enabling slug extraction for cutout of the second layer where slugs are formed from the trepan cutting of larger features as disclosed herein in the second laser cutting. By the use of excimer ablation, cutouts that do not form slugs are enabled so that blind through cuts in the second layer can be made. Thus, in this manner flexibility in achieving the desired functionality can result by coupling the design to the processing methods selected.

Figure 2:
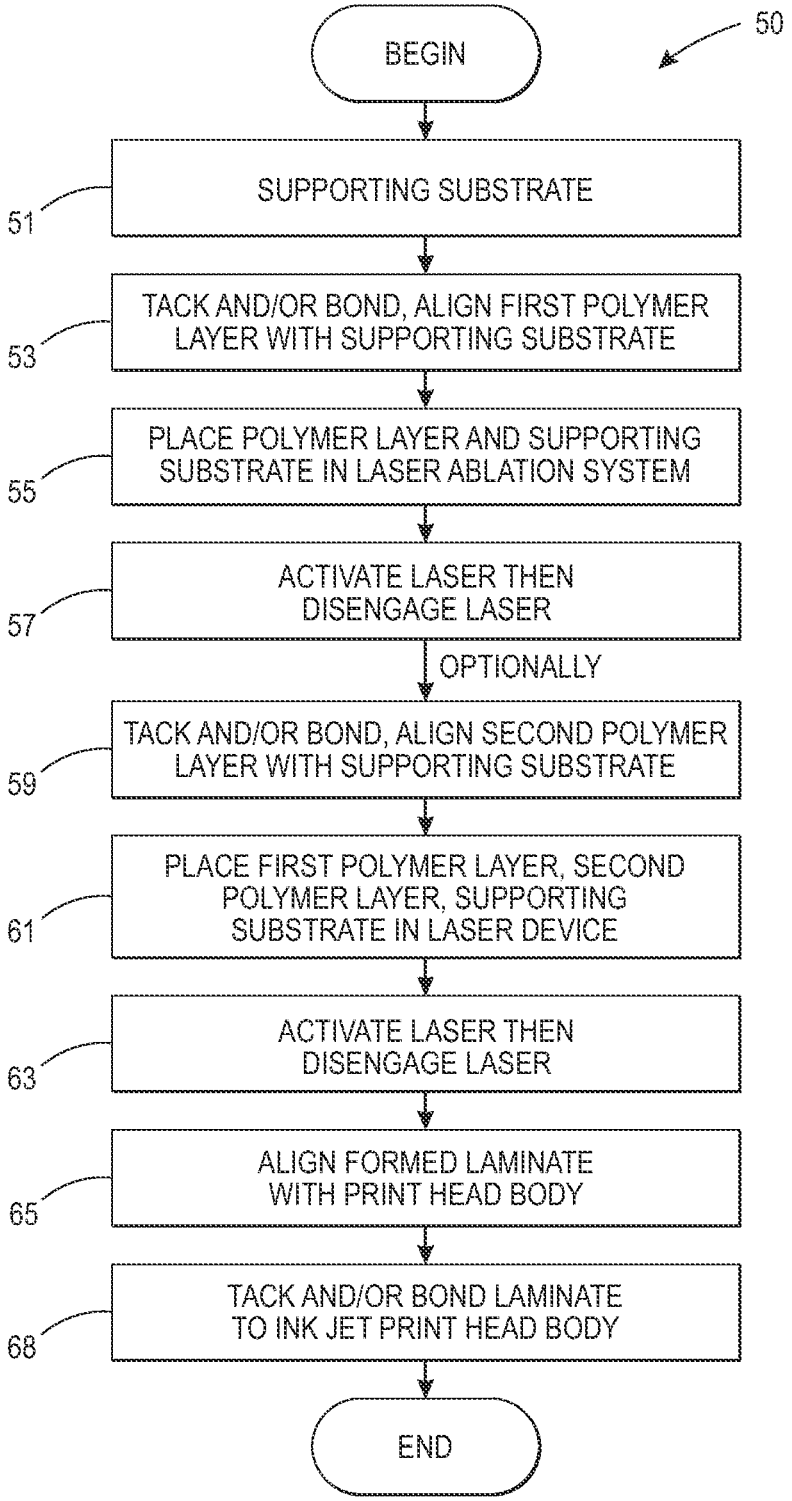
FIG. 2 illustrates an exemplary flow diagram embodiment of the present disclosure.

FIG. 2 illustrates an exemplary process flow diagram embodiment 50 of the present disclosure, beginning with step 51 which is to provide a supporting substrate, such as a mating or outlet plate layer, followed by step 53 which is to tack and/or bond and then align the first polymer layer with the supporting substrate, followed by step 55 which is to place the polymer layer and the supporting substrate in a laser ablation system, followed by step 57 which is to activate a laser source and then disengage the laser, followed by optional step 59 which is to tack and/or bond and then align a second polymer layer with the supporting substrate, followed by step 61 which is to place the first polymer layer, the second polymer layer and the supporting substrate in the laser ablation system, followed by step 63 which is to activate the laser source then disengage the laser, as more specifically illustrated with respect to FIGS. 1A to 1E, resulting in a final laminate where the channels or openings in the supporting substrate, the first and the second polymer layer channels, and the adhesive layers, when present, are aligned with the supporting substrate channels as determined by a microscope, a camera, or a computer, followed by step 65 which is to align the thus-formed laminate with an ink jet print head body, followed by step 68 which is to tack and/or bond the laminate to the ink jet print head body.

The polymer layers and supporting substrate can be cleaned prior to their application by subjecting them to a detergent spray wash and an ultrasonic wash cycle to remove larger contaminants from the surfaces thereof. The resulting laminate after the laser exposures can then be exposed to an oxygen, hydrogen, carbon dioxide, or other gas plasma to increase the surface energy thereof, and remove any contamination. The first polymer layer is then aligned and placed above the fixture which can be a superstructure providing a base with a plurality of pins extending vertically from the base. The pins are arranged to align with tooling holes formed through various plates used in the tacking process. The first polymer is placed on the fixture with the fixture pins extending through tooling holes formed through the first bonding plate. The mating plate or layer of, for example, stainless steel is configured in some instances to have a uniformly flat surface except for the tooling holes.

The tacking process continues by placing the first polymer layers with the adhesive above the mating plate. In this instance, the target layers are the polymer layer and the adhesive material. The polymer layer has tooling holes that accept the fixture pins and align the polymer layer with the bonding plate. Suitable adhesive materials include adhesive tapes having thermoset or thermoplastic adhesives on opposite sides of a thermoset or thermoplastic polymer core. Alternatively, the adhesive material can be a thermoplastic or thermoset adhesive. The adhesive material itself is positioned using thermal tape capable of withstanding the temperatures of the tacking process. The thermal tape is applied to the edge of the adhesive, leaving the portions of the adhesive that contact the supporting substrate exposed. To further control and distribute pressure optional release sheets or layers like TEFLON™, silicone rubbers, copper, steel wool and the like, and other similar compliant layers can be selected and positioned on the supporting substrate or polymer layers disclosed.

The partial laminate is then placed in a heated pressure chamber in order to tack the polymer layer to the adhesive in situations when the polymer layer does not also function as an adhesive, that is a separate adhesive layer is not present on each of the first polymer and second polymer layers. Pressure is then applied vertically through the second polymer layer, adhesive, first polymer, and the supporting substrate. The combination of heat and pressure causes the adhesive to tack to the polymer layers. In this example embodiment, the tacking is complete after about from 1 to about 5 minutes or from 1 to about 3 minutes of exposure to a temperature of from about 225° C. to about 275° C., of from about 240° C. to about 250° C., at a pressure of from about 125 to about 175, or from about 135 to about 150 psi.

The laser system or source is as disclosed herein, and thus can be an imaging laser system where a laser-illuminated mask is imaged onto the second polymer film to create the desired pattern.

Thereafter, the formed laminate with at least one first polymer layer and at least one second polymer layer each with aligned openings therein, as determined by, for example, a microscope, a camera, or a computer, is cleaned of contamination and debris generated as a result of handling and laser ablation by a wash-line with water and a detergent like Bio-Act40®, and oxygen plasma cleaning. However, other suitable or known cleaning methods and a combination of cleaning methods can be selected for the removal of contamination and debris.

The laser beam ablating openings are formed through the portions of the polymer layers that are not covered by the supporting substrate. In this process aspect, the supporting substrate provides alignment features to locate the laser drilled apertures with reference to the supporting substrate. The laser can also drill through the multiple layers that may include an adhesive on the supporting substrate side and an anti-wetting coating.

The processes disclosed in the relevant Figures are merely illustrative of possible embodiments for tacking and bonding the polymer layers, adhesives, and supporting substrate, and alternative processes are envisioned. A possible alternative process could tack, could bond, or could tack and bond the adhesive materials to the supporting substrate before tacking and bonding to the respective polymer layers. Also, the polymer layer may be formed from a thermoset compound or another form of polymer that is self-adhering. In another embodiment, there can be selected polymers that do not require a separate tacking process to align the polymer layer with the supporting substrate. These alternatives usually select bonding in the absence of tacking. Further, the configurations of the laminated structure disclosed herein can be related to the materials selected for each layer and the design selected, thus, for example, tacking without bonding may be sufficient.

Tack or tacking means, for example, where the at least one polymer layer absent an adhesive, is simply placed in contact with the supporting substrate and where the polymer is not fully adhered to the substrate. Bond or bonding means, for example, where the at least one polymer layer is adhered to the supporting substrate, and where there is selected, for example, a separate adhesive as illustrated herein, or a polymer that also functions as an adhesive.

The generated laminates disclosed herein can be comprised of a plurality of laminates, such as from 1 to about 25, from 1 to about 18, from 1 to about 12, from 1 to about 10, from 1 to about 5 laminates, operatively connected for use in an ink jet system, and where the laminate is subsequently internally attached to an ink jet stack or is the final layer of the ink jet stack for use in a solid ink jet device.

Supporting Substrates

The supporting substrate layer or plurality of substrate layers can be any suitable material that, for example, provides rigidity to the structure and is of a thickness of, for example, of from about 10 microns to about 1,000 microns, from about 75 to about 500 microns, from about 175 microns to about 300 microns, from about 25 to about 1,500 microns, from about 50 to 1,000 microns, from about 100 to about 800 microns, from about 250 to about 500 microns, from about 25 to about 1,000 microns, or from about 25 microns to about 310 microns.

Supporting substrate examples include metals, such as stainless steel; ceramics, in a thickness of, for example, from about 25 to about 1,500 microns or from about 250 to about 500 microns, such as alumina, titania, and silica glass; silicon, injection molded plastic, and the like. Also, the supporting substrates can be comprised of polymers or a plurality of polymers, such as the polyimides illustrated herein; can be partially etched, such as from about 25 to about 90, or from about 25 to about 50 percent metals, and where the laser processing can be accomplished only on one side of the supporting substrate.

The supporting substrate dimensions are dependent on a number of factors, such as the type of printing processes selected, and other known factors. Generally, the supporting substrate is at least, for example, about 50 millimeters in length, such as from about 50 to about 500, from about 100 to about 400, from about 300 to about 700, from about 325 to about 600, or from about 400 to about 575 millimeters, and where the laser features on both the first and second polymer layers are aligned to the supporting substrate. The pitch of the openings, such as circular openings on the polymer layers, can be from about 0.25 to about 5 millimeters, from about 0.5 to about 2 millimeters, or from about 1 to about 1.5 millimeters along the short axis and about from about 125 to about 140 or from about 130 to about 1.35 millimeters (mm) along the long axis and this can be repeated at from about 8 and about 220 times along these respective axis for a total of from about 5,000 to about 20,000 or more, from about 5,100 to about 10,200, from about from about 7,000 to about 12,000, from about 1,500 to about 1,800 features or channels, and more specifically, from about 1,750 to about 1,760 features that are properly aligned. Aligning this large number of features in such a dense configuration can be provided with the disclosed processes as compared, for example, to where a post-laser process is used, and where there is an absence of tacking, bonding, or a combination of taking and bonding of the polymer layers to the supporting substrate.

Polymers

With further reference to FIGS. 1 and 2, the first and second polymer layers can be comprised of a plurality of layers, or at least one first polymer layer and at least one second polymer layer (not shown), such as from about 1 to about 15, from about 2 to about 7, from about 1 to about 5, from about 1 to about 3, from about 1 to about 2, or from about 3 to about 5 polymer layers, of a suitable thickness of, for example, from about 10 to about 350 microns, from about 25 to about 250 microns, from about 25 to about 150 microns, from about 75 to about 150 microns, from about 1 to about 100 microns, from about 5 to about 80 microns, from about 10 to about 70 microns, from about 15 to about 50 microns, from about 20 to about 35 microns, or from about 25 to about 75 microns, and the like, can be comprised of various suitable polymers, inclusive of thermoplastic polymers and thermosetting polymers, such as polyimides, polyetherether ketones, polysulfones, polyesters, polyethersulfones, polyimideamides, polyetherimides, polyethylenenaphthalenes, and the like. The polymer layer or polymer layers can be comprised of self-adhesive thermoplastic resins, self-adhesive thermosetting resins, or have a layer of separate adhesives as illustrated herein. Thus, there can be included polymer layers with an adhesive on each surface thereof with one adhesive layer in contact with the supporting substrate and one adhesive layer in for contact with an ink jet assembly, such as an ink jet print head. The other adhesive layers present on the polymer layers are in contact with each other.

Examples of the polyimides selected for the at least one first polymer layer and for at least one of the second polymer layer include known low temperature, and rapidly cured polyimide polymers, such as VTEC™ PI 1388, 080-051, 851, 302, 203, 201, and PETI-5, all available from Richard Blaine International, Incorporated, Reading, Pa. These thermosetting polyimides can be cured at temperatures of from about 180° C. to about 260° C. over a short period of time, such as from about 10 to about 120 minutes, or from about 20 to about 60 minutes, and generally have a number average molecular weight of from about 5,000 to about 500,000, or from about 10,000 to about 100,000, and a weight average molecular weight of from about 50,000 to about 5,000,000, or from about 100,000 to about 1,000,000 as determined by GPC analysis.

Also, there can be selected for the polymer layer or layers thermosetting polyimides that can be cured at temperatures above 300° C., such as PYRE M.L.® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN and FN, all commercially available from E.I. DuPont, Wilmington, Del.

Specific examples of polymer layer or polymer layers thermosetting polyimides include those formed by the imidization of at least one of a polyamic acid of pyromellitic dianhydride/4,4'-oxydianiline, a polyamic acid of pyromellitic dianhydride/phenylenediamine, a polyamic acid of biphenyl tetracarboxylic dianhydride/4,4'-oxydianiline, a polyamic acid of biphenyl tetracarboxylic dianhydride/phenylenediamine, a polyamic acid of benzophenone tetracarboxylic dianhydride/4,4'-oxydianiline, a polyamic acid of benzophenone tetracarboxylic dianhydride/4,4'-oxydianiline/phenylenediamine, and the like, and mixtures thereof. The heating and curing may be at temperatures that are suitable to cause the imidization of the polyamic acid, which temperature is believed to be from about 235° C. to about 370° C., from about 260° C. to about 350° C., or from about 275° C. to about 330° C.

Adhesives

A suitable adhesive layer or plurality of layers include double sided adhesive tapes having thermoset or thermoplastic adhesive layers on opposite sides of a thermoset or thermoplastic polymer core. Alternatively, the adhesive layer or layers can be comprised of a thermoplastic polymer or a thermosetting polymer, or a dispensed or transfer film of a liquid adhesive.

Adhesive layer examples include known resins or components of, for example, epoxies, polyurethanes, acrylics, polyesters, cyanonitriles, nitriles, phenolics, polysulfones, suitable tapes, and blends of these adhesives. Specific examples of adhesives are DuPont E®, DuPont E11-100® and DuPont Kapton® EKJ all available from DuPont Chemicals.

The adhesive layer may have a thickness in a range of from about 1 to about 25 microns, from about 1 to about 18 microns, from about 3 to about 9 microns, from about 2 to about 5 microns, or from about 2 to about 3 microns. Pressure and heat can be applied to the polymer layer or polymer layers, adhesive, and supporting substrate to secure the bond between the polymer or polymers layer and the supporting substrate. For example, there can be applied a pressure of about 290 psi at 350° C. for about 30 minutes to secure the bond.

Lasers

The laser source selected for the generating of the aligned openings in the disclosed laminates can be an imaging laser system where a laser-illuminated mask is imaged onto the supporting substrate, polymer, or polymer films to create the desired aligned patterns therein. Imaged laser systems include excimer lasers and TEA carbon dioxide lasers. In one method a KrF excimer laser with a wavelength of 248 nm (nanometers) or a wavelength of 308 nm illuminates a mask and is imaged onto the layers with a laser fluence in a range of from about 250 mJ/cm$^2$ to about 800 mJ/cm$^2$, with a corresponding flux of from about 7 MW/cm$^2$ to about 23 MW/cm$^2$ per laser pulse. Features or openings are etched into or through the polymer film or polymer films, and optionally the supporting substrate with multiple pulses from the laser. Alternately, the laser system could also be a scanned laser system that either moves the substrate under the laser or uses galvanometers to scan the laser beam over the layers, and where the laser can include but is not limited to a diode pumped solid state laser, a carbon dioxide laser, and fiber laser, and more specifically, a third harmonic of a diode pumped solid state Nd vanadate laser operating at a wavelength of 355 nm that is scanned by a galvanometer and focused with a scan lens onto the substrate. Scanning of the focused laser beam with the galvanometer will cut features, such as channels or aligned openings, in the layers being treated.

Scanning of the focused laser beam with the galvanometer will cut or etch features, such as channels or openings in the polymer films that are aligned with the supporting substrate openings.

In some embodiments of the present disclosure, the layer or layers of the laminate being treated are placed in two different separate laser systems to cut different preselected features, such as channels or openings. Alternatively, ablation may be achieved using a solid state laser operating at 266 nm (nanometers) or 355 nm in a range of from about 10 KHz to about 250 KHz at a power level in a range of from about 0.5 W to about 25 W. For forming the channels or openings illustrated herein there may, it is believed, be used in place of lasers a number of etching processes such as photo-etching, electro-etching, and chemical etching.

Advantages are enabled by drilling the apertures, or other functional features, such as filters and fluidic passages of the laminate or array after the each of the first and second polymer or plurality of polymers, are bonded to the supporting substrate, in that all of the apertures or openings can be within from about 3 to about 10, or from about 4 to about 6, and more specifically, about 5 microns of the aligned positions over lengthy linear distances of equal to or from about 25 millimeters (mm) to greater than or equal to about 300 mm, such as from about 25 to about 700, from about 50 to about 600, from about 100 to about 400, or from about 100 to about 300 nm. The ability to maintain the straightness over the long axis of the array is a particularly excellent advantage over drilling the apertures or openings in the polymer or polymers prior to bonding. The alignment targets may be features for mechanical alignment to the head body or optical alignment targets for active optomechanical alignment.

Uses

The laminates obtained with the processes illustrated herein can be selected for a number of apparatuses, inclusive of the ink jet systems referred to herein, such as aqueous ink jet, solid ink jet, xerography, and the like, and where for the ink jet uses the laminates can be fabricated into or be incorporated into known ink jet heads, such as those illustrated in U.S. Pat. Nos. 7,600,863; 6,135,586; 6,386,434; 8,205,970, and 8,240,818, the disclosures of each of these patents being totally incorporated herein by reference. More specifically, the laminates generated with the processes as illustrated herein can be selected for the internal incorporation thereof into a piezoelectric inkjet print head comprising a body layer in which a plurality of pressure chambers is configured; a flexible diaphragm plate located proximate the body layer; a layer of piezoelectric transducers, each piezoelectric transducer having a bottom surface attached to the diaphragm plate.

The inkjet ejector has a body or frame that is coupled to an ink manifold through which ink is delivered to multiple inkjet bodies. The body also includes an ink drop forming orifice or nozzle through which ink is ejected. In general, the inkjet print head includes an array of closely spaced inkjet ejectors that eject drops of ink onto an image receiving member such as a sheet of paper or an intermediate member. Ink flows from the manifold to nozzle in a continuous path. Ink leaves the manifold and travels through a port, an inlet, and a pressure chamber opening into the body an ink pressure chamber. Ink pressure chambers are bounded on one side by a flexible diaphragm. A piezoelectric transducer is secured to the diaphragm by any suitable technique and overlays the ink pressure chamber. Metal film layers, to which an electronic transducer driver is electrically connected, can be positioned on either side of the piezoelectric transducer.

Ejection of ink droplets are commenced with a firing signal. The firing signal is applied across the metal film layers to excite the piezoelectric transducer 32, which causes the transducer to bend. Because the transducer is rigidly secured to the diaphragm, the diaphragm deforms to urge ink from the ink pressure chamber through the outlet port, the outlet channel, and the nozzle. The expelled ink forms a drop of ink that lands onto an image receiving member. Refilling of the ink pressure chamber following the ejection of the ink drops is augmented by reverse bending of the piezoelectric transducer and the concomitant movement of the diaphragm that draws ink from the manifold into the pressure chamber.

There is also disclosed herein laminates with a supporting substrate and at least one polymer layer positioned to be the internal part of a known ink jet stack assembly rather than being the final external outside layer of the ink stack.

Also, disclosed are micro-channel heat exchangers and similar devices that incorporate the laminated products illustrated herein, and where the disclosed mating plate products can be selected xerography, bookmaking machines, facsimile machines, multi-function machine, and the like, which performs a print outputting function for a number of known purposes, including chemical and bio assay printed thin film devices, three-dimensional model building devices and other applications.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A process consisting of applying to a supporting substrate layer, at least one first polymer layer, and at least one second polymer layer and subjecting the supporting layer and the at least one first polymer layer and the at least the one second polymer layer to a laser source that forms openings in said supporting substrate and said at least one first polymer layer, and said at least one second polymer layer and where openings in the at least one first polymer layer and at least the one second polymer layer are aligned with the openings in the supporting substrate, wherein the at least one first polymer layer and the at least one second polymer layer are selected from the group consisting of a polyimide, a polyester, a polyetherimde, a polyetheretherketone, a polysulfone, and a polyether sulfone.

2. A process in accordance with claim 1 wherein the at least one second polymer layer is free of contact with and in opposite position to the at least one first polymer layer.

3. A process in accordance with claim 1 wherein said polymer layers are tacked and then bonded to said supporting substrate by heat and pressure prior to being subjected to said laser source.

4. A process in accordance with claim 1 wherein each of said at least one first polymer layer and each of said at least one second polymer layer include at least one adhesive layer, wherein at least one for said first polymer layer and said second polymer layer is from about 1 to about 15 layers.

5. A process in accordance with claim 4 wherein said adhesive layer is located on the at least first and on the at least second polymer layers which adhesive is in contact with the supporting substrate positioned between the said at least first polymer layer and said at least one second polymer layer, and where an adhesive layer is additionally present on each of the at least first and the at least second polymer layers which adhesive is positioned opposite the adhesive surfaces that contact the supporting substrate.

6. A process in accordance with claim 4 wherein at least one for said first polymer layer and said second polymer layer are each from about 1 to about 2 layers.

7. A process in accordance with claim 1 wherein the supporting substrate consists of a metal or a polymer, the at least one first polymer layer is a polyimide, the at least one second polymer layer is a polyimide, and where the openings therein are formed and aligned by said laser of a solid laser source, a carbon dioxide laser source, an excimer laser source, or a fiber laser source.

8. A process in accordance with claim 1 wherein the at least first polymer layer and the at least second polymer layer are comprised of a polyimide, and the supporting substrate is comprised of at least one polymer or at least one metal.

9. A process in accordance with claim 1 wherein the at least one first polymer layer and the at least one second polymer layer are a polyimide, and wherein the supporting substrate consists of stainless steel, at least one polyimide polymer, a ceramic, glass, or silicon.

10. A process in accordance with claim 1 where the shape of said openings are rectangular, circular, square, or combinations thereof, and wherein said aligned openings are present on from about 25 to about 90 percent of the supporting substrate layer, the at least first polymer layer and the at least second polymer layer, wherein said at least one for said polymer layers is from 1 to about 5 layers, and further containing at least one adhesive layer on each of said first and said second polymer layers, which adhesive consists of an epoxy resin, a polyurethane, an acrylic, a cyanonitrile, a phenolic, a polyester, or a polysulfone.

11. A process in accordance with claim 1 wherein the at least one first polymer layer and the at least one second polymer layer consists of a thermosetting polymer core layer situated between two thermoplastic polymer layers.

12. A process in accordance with claim 1 wherein said laser source is a diode pumped solid laser, a carbon dioxide laser, or a fiber laser.

13. A process in accordance with claim 1 wherein said laser source is an excimer laser.

14. A process in accordance with claim 1 wherein prior to said laser source the supporting substrate, the at least one first polymer layer and the at least one second polymer layer are cleaned to remove debris therefrom, and wherein said cleaning is accomplished with an oxygen plasma and water, said supporting substrate is a mating plate, and said at least one first polymer and said at least one second polymer are from 1 to about 3 polymers.

15. A process consisting essentially of providing a supporting layer that includes openings therein, and where said supporting substrate layer is situated between and is in contact with at least one polymer layer optionally containing an adhesive layer on at least one lateral surface thereof; applying the said at least one polymer layer on the top surface of the supporting layer and subjecting the supporting layer and the at least one polymer layer to a laser that forms openings in said at least one polymer layer; applying at least one second polymer layer on the bottom surface of the supporting layer and subjecting the at least one second bottom polymer layer to a laser that forms openings in said at least one second polymer layer, and where openings in the at least one first polymer top layer and the openings in the at least one second polymer bottom layer are aligned with the openings in the supporting substrate, wherein the at least one first polymer layer and the at least one second polymer layer consist of a polyimide.

16. A process in accordance with claim 15 wherein at least one first polymer layer and the at least one second polymer layer are each from 1 to about 5 layers, wherein each of said at least one first polymer layer and each of said at least one second polymer layer includes at least one adhesive layer, wherein said openings therein are formed and aligned by said laser of a solid laser source of a carbon dioxide laser source, an excimer laser source, or a fiber laser source.

17. A process in accordance with claim 16 wherein said adhesive is an epoxy resin, a polyurethane, an acrylic, a cyanonitrile, a phenolic, a polyester, a polysulfone, or mixtures thereof; the supporting substrate is stainless steel, and at least one first polymer layer and at least one second polymer layer are each from 1 to 2 layers.

18. A process in accordance with claim 15 wherein there results a laminate that is incorporated into a solid ink jet apparatus.

19. A solid ink jet device that includes an ink jet stack consisting of at least one first polymer layer, at least one second polymer layer, and situated there between at least one supporting substrate layer, and wherein the supporting substrate layer, the at least first polymer layer and the at least second polymer layer are simultaneously exposed to a laser to generate aligned openings in said supporting substrate layer, said at least one first polymer layer and said at least one second polymer layer and wherein the at least one first polymer layer and the at least one second polymer layer are selected from the group consisting of a polyimide, a polyester, a polyetherimde, a polyetheretherketone, a polysulfone, and a polyether sulfone.

20. A solid ink jet device in accordance with claim 19 where said at least one first polymer layer and said at least one second polymer layer are from 1 to about 10 layers consisting of polyimide polymers, and wherein said supporting substrate is a polymer.

* * * * *